United States Patent [19]

Pillow

[11] 4,312,412

[45] Jan. 26, 1982

[54] FLUID OPERATED ROCK DRILL HAMMER

[75] Inventor: Dan L. Pillow, Garland, Tex.

[73] Assignee: Dresser Industries, Inc., Dallas, Tex.

[21] Appl. No.: 64,287

[22] Filed: Aug. 6, 1979

[51] Int. Cl.[3] ..... E21B 4/14

[52] U.S. Cl. ..... 173/17; 173/66; 173/73; 173/136

[58] Field of Search ..... 173/17, 73, 66, 136

[56] References Cited

U.S. PATENT DOCUMENTS

| | | | |
|---|---|---|---|
| 3,958,645 | 5/1976 | Curington | 173/80 X |
| 4,015,670 | 4/1977 | Rear | 173/80 X |
| 4,084,647 | 4/1978 | Lister | 173/80 X |

*Primary Examiner*—Robert Mackey

*Attorney, Agent, or Firm*—Fred A. Winans; Eddie E. Scott

[57] ABSTRACT

A fluid operated rock drill hammer includes an annular hammer body with the upper end of the hammer body adapted to be connected to a drill string and with a drill chuck mounted at the lower end of the hammer body. A drill bit extends through the drill chuck into the body. A piston is slidably mounted in the hammer body to move axially between the drill bit and the upper end of the hammer body for striking the portion of the drill bit that extends through the drill chuck. The force for moving the piston is provided by a circulating fluid that is transmitted through the drill string into the hammer body. All of the fluid is transmitted between the hammer body and the piston at a single fixed axial position along the length of the hammer body.

1 Claim, 3 Drawing Figures

FLUID OPERATED ROCK DRILL HAMMER

BACKGROUND OF THE INVENTION

The present invention relates in general to the art of earth boring and, more particularly, to a down-the-hole air operated rock drill hammer. Air operated rock drill hammers generally include an annular body portion having a central chamber. A piston is mounted in the central chamber for axial movement to provide hammer blows. A bit is connected to the annular body for receiving the hammer blows. Passage means are provided in the annular body and the piston for delivering driving air to move the piston and alternately strike the hammer blows and recover therefrom. The piston is alternately moved linearly by the presence of air alternately at each end of the piston. The piston strikes the bit at the lower end of travel for impacting the earth formations. The air is controlled by the piston motion.

Prior art rock drill hammers have used extensive and complex ports and porting to supply air to the piston. The piston is usually the valve that controls the air to the chambers on each end of the piston. The designs include two ports into the piston and as well as a multitude of passages and ports that are almost impossible to describe. Some designs involve extensive machining on the piston diameter with staggered ports and passages in the cylinder case.

DESCRIPTION OF PRIOR ART

In U.S. Pat. No. 3,896,886 to Theodore J. Roscoe, Jr., patented July 29, 1975, an air hammer embodying an outer housing structure connectable to a rotatable drill pipe string through which compressed air is conducted is shown. A hammer piston reciprocates in the housing structure, compressed air being directed alternately to the upper and lower ends of the piston to effect its reciprocation in the structure, each downward stroke impacting an impact blow upon the anvil portion of an anvil bit extending upwardly within the lower portion of the housing structure. The flow of air to the upper and lower ends of the hammer piston is controlled by valve passages formed in the piston and a relatively stationary air supply tube which closes the passage to the lower end of the piston when the outer housing structure is lifted by the drill pipe string to allow the bit to hang down from the housing during the circulation of air for flushing cuttings from the borehole.

In U.S. Pat. No. 4,015,670 to Ian Graeme Rear, patented Apr. 5, 1977, a fluid operated hammer is shown. The fluid operated hammer for rock drills includes a cylinder, a drill chuck mounted at one end to receive a drill bit; a drill sub attached to the other end; a tubular fluid feed tube mounted in the drill sub and extending towards the chuck, the longitudinal central axis of the feed tube corresponding to the longitudinal central axis of the cylinder; at least one set of apertures provided in the side wall of the feed tube and spaced from each end; a piston slidably mounted in the cylinder and over the feed tube to move between the drill chuck and drill sub, the lower end being adapted for striking a portion of the drill bit extending through the drill chuck; a first passageway in said piston communicating with one end face thereof and opening into the center of the piston at a location spaced along the length of said piston; a second passageway in said piston communicating with the end face of the piston communicating with the end of the piston opposite to that of the first passageway and opening into the center of the piston at a location spaced along said piston, said first passageway communicating with one of said set of apertures in the feed tube when the piston is in abutting relationship with the chuck to admit fluid into the space between the piston and drill chuck to drive the piston upwards and said second passageway communicating with one of said set of apertures when the piston is at its upper position in the cylinder to admit fluid into the space between the piston and drill sub to drive the piston downwards.

Numerous designs of rock drill hammers are in commercial use. A typical example is shown in FIG. 3 on page 2 of the *Operation and Maintenance Manual* published by TRW Mission, dated March 1974.

SUMMARY OF THE INVENTION

The present invention provides a fluid operated rock drill hammer having an annular hammer body. A drill chuck is mounted at the lower end of the hammer body. A drill bit extends through the drill chuck into the body. The upper end of the hammer body is connected to a drill string. A moveable piston is slidably mounted in the hammer body to move between the drill bit and a higher position for striking hammer blows to the drill bit. A passage system is located in said hammer body and passage systems are located within said moveable piston for transmitting a circulating fluid to move the piston. A monadic transfer means is located at a single fixed axial position on the hammer body for allowing the circulating fluid to be transmitted between said passage system in said hammer body and said passage systems in said moveable piston for allowing said circulating fluid to move said piston and strike said hammer blows. The single position transfer system provides a rock drill hammer that is simpler and less expensive to manufacture. The length of the piston and the length of the entire hammer are reduced. The hammer can operate at a higher frequency. The foregoing and other features and advantages of the present invention will become apparent from a consideration of the following detailed description when taken in conjunction with the drawings.

DETAILED DESCRIPTION OF THE INVENTION

Figure 1:
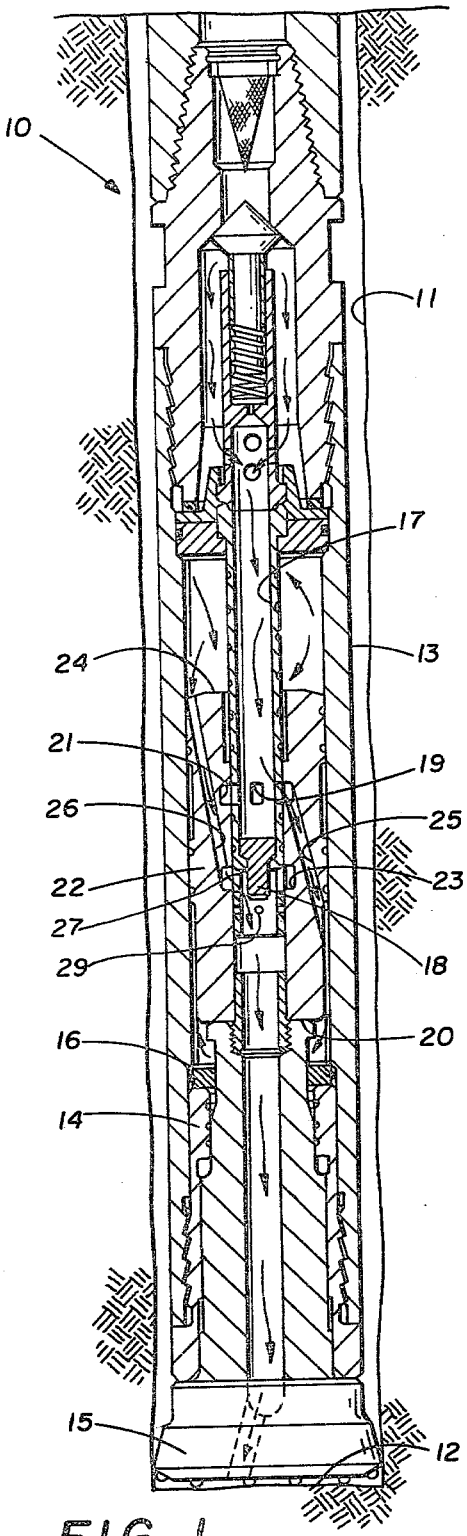
FIG. 1 illustrates a rock drill hammer with a sliding piston delivering a hammer blow to the drill bit.
Figure 2:
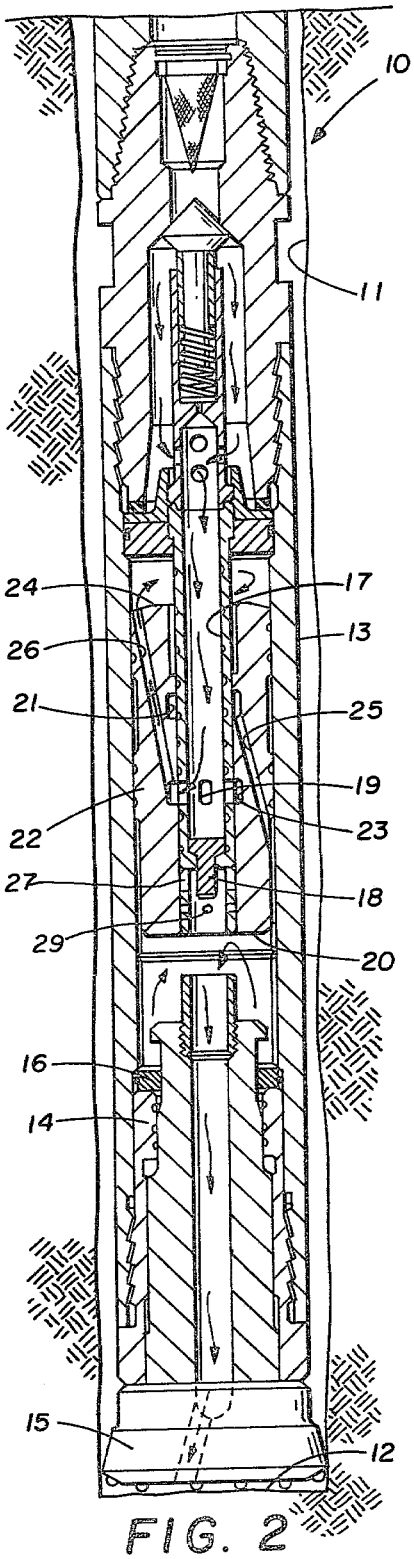
FIG. 2 illustrates the rock drill hammer with the sliding piston in the uppermost position.
Figure 3:
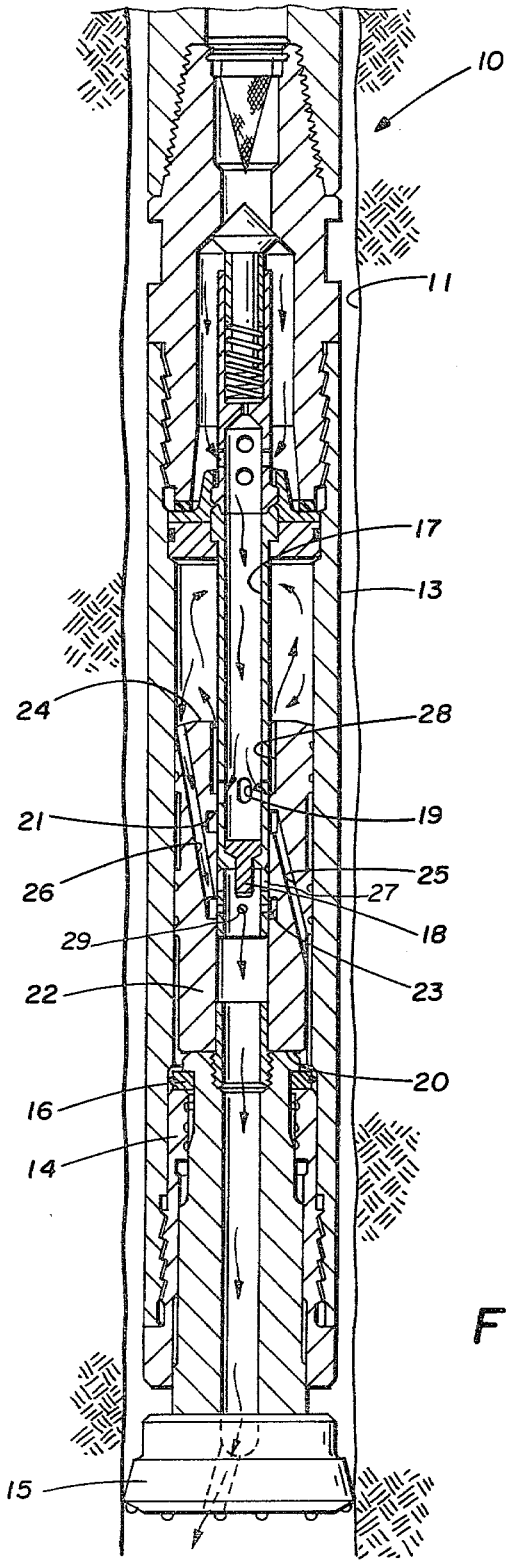
FIG. 3 illustrates the rock drill hammer with the drill bit off bottom.

Referring now to the drawings, a fluid operated rock drill hammer 10 is shown in three different stages of operation in FIGS. 1, 2 and 3. The hammer 10 is shown in an earth borehole 11. In FIGS. 1 and 2 the hammer 10 is on the bottom 12 of the borehole 11 and in position for drilling. In FIG. 3 the hammer 10 has been lifted off the bottom 12 of the borehole 11 and the drilling fluid is circulating through and out of the hammer 10.

The hammer 10 comprises a cylinder 13 with a drill chuck 14 at one end. The drill chuck 14 receives a drill bit 15. The bit 15 is retained in the chuck 14 by retaining ring 16. When bit 15 is on bottom and projecting into the cylinder 13 there is a limited amount of longitudinal movement provided between the bit 15 and retaining ring 16. The cylinder 13 is connected by its upper end to a drill string (not shown). A compressed air supply is transmitted down the drill string.

A feed tube 17 is mounted in the cylinder 13. The feed tube 17 extends from the upper end of the cylinder 13 toward the chuck 14 but terminates just above the drill bit 15. The longitudinal central axis of the feed tube 17 corresponds with the longitudinal central axis of the cylinder 13. The feed tube 17 is restricted or blocked by a choke constituting a reduced diameter plug 18 that reduces or blocks the fluid flow through the feed tube 17 providing higher pressure in that portion of the tube above the choke 18. A single or monadic set of pressurizing apertures 19 is provided in the wall of the feed tube 17. The set of apertures 19 includes four individual apertures spaced circumferentially around the feed tube 17 at a single fixed axial position upstream of the plug 18. A set of exhaust ports 27 are provided in the tube below the choke 18.

An annular piston 22 is slidably mounted in the cylinder 13 to move between the drill bit 15 and the upper end of the cylinder 13. The piston 22 includes a diametric grooved channel 21 extending around the internal piston wall. The channel 21 has fluid communication through longitudinal passageway 25 in the piston to the lower surface 20 of the piston 22. A second diametric channel 23 extending around the internal piston wall below the previous groove is connected through longitudinal passageway 26 to the end face surface 24 at the upper end of piston 22. It is to be understood that the lower surface and upper surface could be the end faces shown or surfaces at different angles to the central axis of the piston.

The hammer utilizes only the single pressurizing port system 19 in feed tube 17 located at a single fixed axial position along the length of the cylinder 13 to transmit pressurized air through the passages 25 or 26. This provides a simpler, less expensive way to manufacture a percussion hammer. This leads to simpler, easier machining of most parts of the percussion hammer other than the piston. The single port system allows for more variations in design parameters for the percussion hammer. The overall length can be shortened along with the piston. The shorter the piston the lighter it can be made, making it and the hammer more efficient. Also the frequency of the stroke of the hammer is increased resulting in better drilling.

The structural elements of a rock drill hammer 10 constructed in accordance with the present invention having been described, the operation of the hammer 10 will now be considered. FIG. 1 illustrates the piston 22 at its lowermost position in contact with the drill bit 15. The upper end of the drill bit 15 is provided with an anvil surface that is struck by the hammer surface on the lower end face 20 of piston 22. The hammer force is transmitted through the bit 15 to the formations at the bottom 12 of the borehole 11 thereby fracturing the formations and extending the borehole into the earth.

Prior to the hammer blow being imparted to the bit 15, the piston must be moved upward. When the piston is in its lowermost position as shown in FIG. 1, the upper channel 21 in the piston 22 is adjacent the single set of pressurizing apertures 19 in the feed tube 17. High pressure air is forced through passage 25 into the sealed space between (A) the lower end face surface 20 of the piston 22 and (B) the drill bit 15. This drives the piston 22 upward. Air trapped by upward movement of the upper end face 24 of the piston 22 is compressed between the upper surface of the piston 22 and the upper portion of the cylinder 13 prior to being vented through the feed tube. This provides a cushioning effect to retard the further upward movement of the piston 22. The air is vented through passage 26 which in this position are adjacent exhaust apertures 27 in the feed tube 17 below the plug 18.

When the piston is at its uppermost position as shown in FIG. 2, the lower channel 23 in the piston 22 is adjacent the single set of pressurizing apertures 19 in the feed tube 17. This provides pressurized fluid communication with the sealed volume above the upper end face 24 of the piston 22 through passage 26. The upper channel 21 is blocked by the feed tube 17. As a result, high pressure air is admitted to the volume above the piston 22 to drive the piston 22 down the cylinder 13 and onto the drill bit 15 to provide the desired hammer blow.

It is often necessary to stop the hammering during the drilling operation. In order to cease hammering, the drill string is raised to permit the drill bit 15 to drop in the chuck 14 to its lowermost position as shown in FIG. 3. The bit 15 is then supported by the retaining ring 16. As a result of the bit 15 being lower in the cylinder 13 than during the hammering operation, the piston 22 abuts the drill bit 15 and the upper groove 21 in the piston is blocked by the feed tube 17 to prevent any air flow into passage 25 or into the space below the lower end of the piston 22. The piston 22 remains in its lowermost position without the hammering action previously described. The circulating air is allowed to travel through the hammer 10. The enlarged bore portion 28 surrounding feed tube 17 at the upper end of the piston 22 is located adjacent the set of pressurizing apertures 19 on the feed tube 17. As a result, air from the apertures 19 flows into the space defined above the upper end of the piston 22, down the passageway 26 through the lower groove 23 in facing alignment with apertures 29 in the tube below the plug 18 and out of the drill bit 15. Thus by raising the drill string and permitting the drill bit 15 to drop in the chuck 14 not only is the hammer deactivated but also the flow of air through the bit 15 is maintained to clear cuttings from the area of the bit 15 at the bottom 12 of the borehole 11.

The embodiments of an invention in which an exclusive property or privilege is claimed are defined as follows:

1. A pressurized fluid operated rock drill hammer, comprising:

an annular body defining a cylindrical chamber having an upper end and a lower end;

a drill chuck mounted at the lower end of said body;

a drill bit connected to said drill chuck and extending into said chamber;

a tubular fluid feed tube mounted in said body and extending into said chamber from said upper end toward the drill chuck and defining a high pressure section above a choke member in the lower end of said tube;

a set of apertures in said feed tube located at a single axial position for transmitting all of said pressurized fluid to said chamber;

a piston slidably mounted in said chamber and having an axial bore for slidingly engaging said feed tube and moveable between a position impacting the drill bit at the lower end of the chamber and an elevated position at the upper end of said chamber, said piston having an upper surface and a lower surface;

a first passageway in said piston for fluid communication from the lower surface of the piston to a first channel open to said axial bore;

a second passageway in said piston for fluid communication from the upper surface of the piston to a second channel open to said axial bore;

an exhaust passage for discharging pressurized fluid from said chamber through said bit, said exhaust passage having an inlet below said choke member;

said first passage providing fluid communication between said set of apertures in the feed tube and the lower face of said piston when the piston is in abutting relationship with the drill bit to admit pressurized fluid into the space between the piston and drill bit to drive the piston upward to said elevated position and said secondary passageway concomitantly providing fluid communication between said upper face and said exhaust inlet below said choke member to permit escape of fluid from said chamber above said piston, and said second passage providing fluid communication between said set of apertures and the upper face of said piston when the piston is at its upper position in the chamber to admit fluid between the piston and the upper end of the chamber to drive the piston downward.

* * * * *